US010443555B2

(12) United States Patent
Schmitz et al.

(10) Patent No.: US 10,443,555 B2
(45) Date of Patent: Oct. 15, 2019

(54) VALVE ARRANGEMENT AND A HIGH PRESSURE PUMP FOR A FUEL INJECTION SYSTEM OF AN INTERNAL COMBUSTION ENGINE

(71) Applicant: CONTINENTAL AUTOMOTIVE GMBH, Hannover (DE)

(72) Inventors: Norbert Schmitz, Aiterhofen (DE); Michael Mauer, Regensburg (DE); Heiko Zabich, Regensburg (DE)

(73) Assignee: CPT Group GmbH, Hannover (DE)

( * ) Notice: Subject to any disclaimer, the term of this patent is extended or adjusted under 35 U.S.C. 154(b) by 0 days.

(21) Appl. No.: 15/619,083

(22) Filed: Jun. 9, 2017

(65) Prior Publication Data

US 2017/0276111 A1 Sep. 28, 2017

Related U.S. Application Data

(63) Continuation of application No. PCT/EP2015/077813, filed on Nov. 26, 2015.

(30) Foreign Application Priority Data

Dec. 12, 2014 (DE) ..... 10 2014 225 642

(51) Int. Cl.
*F02M 59/46* (2006.01)
*F02M 59/36* (2006.01)
*F02D 41/38* (2006.01)

(52) U.S. Cl.
CPC ..... *F02M 59/462* (2013.01); *F02D 41/38* (2013.01); *F02M 59/366* (2013.01); *F02M 59/367* (2013.01); *F02M 59/368* (2013.01)

(58) Field of Classification Search
CPC .. F02M 59/462; F02M 59/367; F02M 59/368; F02M 59/366; F02D 41/38
(Continued)

(56) References Cited

U.S. PATENT DOCUMENTS 5,027,784 A 7/1991 Osawa et al.
5,507,318 A * 4/1996 Israelson ..... F04B 53/1065 137/854
(Continued)

FOREIGN PATENT DOCUMENTS

CN 102588172 A 7/2012
CN 103649521 A 3/2014
(Continued)

OTHER PUBLICATIONS

International Search Report and Written Opinion dated Jan. 12, 2016 from corresponding International Patent Application No. PCT/EP2015/077813.
(Continued)

*Primary Examiner* — Mahmoud Gimie

(57) ABSTRACT

Embodiments relate to a valve arrangement for a fuel injection system, including a valve disc that has a valve opening. A deformable valve sheet that is movable in a movement direction is provided to open and close the valve opening, and a valve shaft of a movement-activation arrangement, provided to activate the movement of the valve sheet, is secured to the valve sheet. The embodiments also relate to a high-pressure pump which includes the valve arrangement.

11 Claims, 12 Drawing Sheets

(58) Field of Classification Search
USPC ..... 123/445
See application file for complete search history.

(56) References Cited

U.S. PATENT DOCUMENTS

| | | | | |
|---|---|---|---|---|
| 6,517,044 | B1 * | 2/2003 | Lin | F16K 31/0696 251/129.19 |
| 8,474,436 | B2 | 7/2013 | Mancini et al. | |
| 9,383,028 | B2 | 7/2016 | Bleeck et al. | |
| 2006/0000995 | A1 * | 1/2006 | Parsons | F16K 7/14 251/129.17 |
| 2006/0275166 | A1 * | 12/2006 | Mattioli | F02M 59/102 417/571 |
| 2012/0138021 | A1 | 6/2012 | Kim et al. | |
| 2012/0180755 | A1 | 7/2012 | Jung et al. | |
| 2012/0255636 | A1 | 10/2012 | Mancini et al. | |
| 2014/0070124 | A1 * | 3/2014 | Kraft | F02D 41/20 251/129.04 |
| 2014/0154100 | A1 * | 6/2014 | Zeng | F02M 69/02 417/53 |
| 2014/0196691 | A1 * | 7/2014 | Klesse | F02D 41/20 123/480 |
| 2014/0216419 | A1 | 8/2014 | Wirkowski et al. | |
| 2015/0083948 | A1 | 3/2015 | Bleeck et al. | |
| 2015/0337753 | A1 * | 11/2015 | Stickler | F02M 57/02 123/506 |

FOREIGN PATENT DOCUMENTS

| | | | |
|---|---|---|---|
| DE | 102011077577 | A1 | 12/2012 |
| DE | 102013210792 | A1 | 12/2014 |
| EP | 1724467 | A1 | 11/2006 |
| JP | 48-029020 | A | 4/1973 |
| JP | S616475 | B2 | 1/1986 |
| JP | H0377871 | U | 8/1991 |
| JP | H09280386 | A | 10/1997 |
| JP | 2012255433 | A | 12/2012 |
| JP | 2015504130 | A | 2/2015 |
| KR | 20140108322 | A | 9/2014 |
| WO | 2012171890 | A1 | 12/2012 |
| WO | 2013098249 | A1 | 7/2013 |

OTHER PUBLICATIONS

German Office Action dated Feb. 17, 2016 for corresponding German Patent Application No. 10 2014 225 642.9.
German Office Action dated Nov. 11, 2015 for corresponding German Patent Application No. 10 2014 225 642.9.
china Office Action dated Apr. 17, 2018 for corresponding China Patent Application No. 201580021172.X.
Japan Office Action dated Nov. 13, 2017 for corresponding Japan Patent Application No. 2016-562745.
Korean Office Action dated Apr. 25, 2018 for corresponding Korean Patent Application No. 10-2016-7028727.
China Office Action dated Nov. 2, 2018, for counterpart CN patent application 201580021172.X.

* cited by examiner

VALVE ARRANGEMENT AND A HIGH PRESSURE PUMP FOR A FUEL INJECTION SYSTEM OF AN INTERNAL COMBUSTION ENGINE

CROSS REFERENCE TO RELATED APPLICATIONS

This application claims the benefit of PCT International application No. PCT/EP2015/077813, filed Nov. 26, 2015, which claims priority to German patent application No. 10 2014 225 642.9, filed Dec. 12, 2014, each of which is hereby incorporated by reference herein.

FIELD OF INVENTION

The invention relates to a valve arrangement for a fuel injection system of an internal combustion engine, and to a high-pressure pump for a fuel injection system, which high-pressure pump has such a valve arrangement.

BACKGROUND

In the case of fuel injection systems of internal combustion engines, it is known to use high-pressure pumps which apply a high pressure to the fuel to be injected. The fuel that has had such a high pressure applied to it is then injected by way of injectors into combustion chambers of the internal combustion engine. The high pressure of the fuel has a positive effect on the emissions values of the internal combustion engine, in particular for example $CO_2$ emissions. It is therefore sought, in internal combustion engines which use gasoline as fuel, to achieve a pressure in the range from 200 bar-300 bar in the fuel, whereas in the case of diesel internal combustion engines, it is even the case that a pressure range of 2000 bar-3000 bar in the fuel is sought.

For applying the desired pressure to the fuel, the high-pressure pump normally has one piston which increases and decreases the volume of a pressure chamber and, during the decrease in volume, compresses the fuel in order to realize the desired pressure of the fuel. At the pressure chamber there are arranged valves, on the one hand an inlet valve which admits the fuel into the pressure chamber before the fuel is compressed, and on the other hand an outlet valve which discharges the compressed fuel from the pressure chamber into a line which then conducts the fuel, for example via a common rail, to the injectors.

Owing to the high pressures that can be achieved with the high-pressure pump, the closing elements of the valves are commonly of massive form, for example in the form of a ball valve or valve mushroom head, to name but two possible massive embodiments.

Such valve elements are duly highly robust with regard to the prevailing pressures in the high-pressure pump, but react relatively slowly to the forces acting on them.

Since high-pressure pumps commonly operate in the range of several thousand strokes per minute, it is however desirable, in particular, for the admission of the fuel into the pressure chamber to provide relatively fast-switching valves which can open and close quickly.

It is therefore known, for example, to use not ball valves or massive mushroom head closing elements but filigree valve lamellae which are deformable and which can open and close the respective valve by way of their deformation. Such an arrangement is described, for example, in EP 1 724 467 A1.

The valve lamella described in EP 1 724 467 A1 opens and closes owing to pressure differences in the fuel in a pressure chamber of the high-pressure pump. If the pressure in the pressure chamber is higher than that in the suction region arranged upstream of the pressure chamber, the valve lamella closes, whereas the valve lamella opens if the pressure in the suction region is higher than that in the pressure chamber. To hold the valve lamella open in targeted fashion, the valve lamella is, by a valve shank, forced into the open position even counter to a higher pressure in the pressure chamber than in the suction region, in order that the pump power of the high-pressure pump can thereby be set. If it is not sought to manually influence the pump power, the valve shank retracts and is not in contact with the valve lamella, such that the valve lamella can close owing to the pressure prevailing in the pressure chamber.

All known arrangements have the disadvantage that the operation thereof gives rise to a high level of noise generation during switching.

SUMMARY

It is therefore an object of the invention to propose a valve arrangement and a high-pressure pump which overcome the problem.

A valve arrangement for a fuel injection system of an internal combustion engine has at least one valve opening arranged in a valve disk, wherein the valve opening fluidly connects to or is in fluid communication with one another a first valve disk side and a second valve disk side situated opposite the first valve disk side, which valve disk sides are separated from one another by the valve disk. Furthermore, the valve arrangement has a deformable valve lamella which is movable along a movement direction and which serves for opening and closing the valve opening, which valve lamella may, in order to close the valve opening, be brought into contact with a valve disk surface on the first valve disk side. Furthermore, a movement activation arrangement for activating a movement of the valve lamella along the movement direction is provided, which movement activation arrangement has a valve shank which is fixed to the valve lamella.

This has the advantage that the length of the movement of the valve shank is delimited by the valve lamella when the latter comes into contact with the valve disk surface. A situation is thus prevented in which, during operation, the valve shank strikes for example a region of the valve arrangement, causing an activation of the movement of the valve shank. This leads to reduced noise generation by the valve arrangement during operation. Furthermore, it is also possible in this way for protective coatings or cumbersome machining of surfaces of elements of the valve arrangement that otherwise strike one another to be avoided.

Furthermore, the valve arrangement has the advantage that there is no longer a need for additional holding measures for holding the valve lamella in position, such as for example a stopper for preventing the valve lamella from being drawn into the center of the pressure chamber, or a fastening of the valve lamella directly to the valve disk.

It is particularly advantageously the case that the valve shank extends through the valve opening in order that the shank may be connected particularly easily to the valve lamella. It is furthermore advantageous if the valve shank is fixed in the central region of the valve lamella in order to thereby permit a symmetrical introduction of force from the valve shank into the valve lamella.

The valve disk has multiple openings, wherein the valve lamella is designed such that, in the closed position, the valve lamella may close all of the valve openings simultaneously. The valve lamella may in this case be of circular or angular form, wherein it is advantageous for the valve lamella to close all of the valve openings when the lamella bears against the valve disk surface. It is also possible for the valve lamella to be formed with recesses in order to make the lamella even more deformable, wherein then, for the valve openings, there should be provided corresponding valve lamella regions which may then close the valve openings.

The valve shank is fixed to the valve lamella in one embodiment by a screw connection, wherein a screw element bears against the valve lamella, in particular on a first valve lamella side facing away from the second valve disk side, and extends through the valve lamella. Screw connections of elements may, with a sufficient resistance, oppose the high load that acts on the connection owing to the high pressure in the pressure chamber. It is additionally advantageous if the screw element bears against the valve lamella, for example has a screw head which bears against the valve lamella, and thus supports the valve lamella during the movement thereof. In this way, the filigree valve lamella may altogether likewise be made advantageously more robust.

It is additionally or alternatively also possible, in an embodiment, for the valve shank to be fixed by a welded connection to the valve lamella. Welded connections also offer a high level of stability and may therefore advantageously contribute to the durability of the connection. It is particularly advantageous for a welded connection of this type to be arranged such that it may preload the valve lamella counter to a force acting on the valve lamella from the direction of the pressure chamber, that is to say may exert a pressure on the valve lamella in the direction of the pressure chamber. In this way, the open position of the valve lamella during the delivery stroke of the high-pressure pump is additionally assisted.

In addition or alternatively, on the valve lamella, there is arranged a sleeve-shaped receiving element which is in engagement with the valve shank. In this way, an advantageous form fit is provided between the valve lamella and the valve shank, which form fit may likewise contribute to durability of the connection.

For example, in one embodiment the receiving element may in this case be crimped to the valve shank in order to realize the form fit. The bead formed here ensures a particularly advantageous sealing action of the connection.

In another embodiment, the receiving element is a circlip which is in engagement with the valve shank.

As a further alternative, in another embodiment the receiving element is formed by a clip element which engages behind the valve lamella and thus ensures a secure connection between valve lamella and the valve shank.

In another embodiment, the receiving element is formed by a valve lamella opening which is arranged in the valve lamella and which has opening walls which are in engagement with the valve shank. This embodiment is particularly easy to produce.

In another embodiment, however, alternatively the valve lamella is formed integrally with an end of the valve shank, facing toward the first valve disk, which has the advantage that, in this way, it is possible to eliminate potential breaking points of a connection.

In another embodiment, however, the valve lamella has an engagement shank which engages through the valve opening into a recess of the valve shank and may thus produce a robust connection by a form fit with the end of the valve shank. It is particularly advantageous if the engagement shank also engages through the valve lamella and is additionally advantageously fastened by welded connections to the valve lamella. Here, it is particularly advantageous for not just one welded connection to the valve lamella be provided but for in each case one welded connection on two valve lamella surfaces to connect the valve lamella to the engagement shank. This ensures a particularly reliable and firm connection of engagement shank, valve lamella and thus also valve shank.

The valve lamella is in the form of a spring element whose spring force is directed counter to a force which acts on the valve lamella from a first valve lamella side. For example, here, the valve lamella may be in the form of a disk spring or leaf spring. It is also possible for the valve lamella to be a coil spring or conical spring which has closing elements which may close the at least one valve opening.

Here, it is advantageously the case that the spring force of the valve lamella is greater than a predetermined force which corresponds to a maximum hydraulic force on the first valve lamella side during the operation of the valve arrangement. This means that, when the high-pressure pump pumps fuel, the valve lamella opposes a force generated by the pressurized fuel with enough resistance to remain in the open position. Here, the predetermined force may correspond to a force which is imparted by the fuel when the fuel has been compressed to the maximum extent by the pump piston. In this way, it is advantageously possible, in the event of a breakage of the valve shank, to prevent the valve lamella from closing the valve opening, which would result in the high-pressure pump no longer being capable of imparting a full delivery action. In this embodiment, it is particularly advantageous if the valve shank is provided for moving the valve lamella into the closed position; that is to say if, without activation of the valve lamella, the valve arrangement is open.

The valve lamella is fixed at least in sections to the valve disk. In this way, a valve lamella in the form of a spring element is supported particularly easily on the valve disk. The fixing of the valve lamella to the valve disk may be realized, for example, by welding and/or vulcanizing and/or adhesive bonding or similar connecting methods which may withstand the high pressures in the region of the valve lamella.

In an advantageous refinement, the movement activation arrangement has a magnetic actuator with a static pole piece and an armature which is connected to the valve shank and serves as a positioning element. Here, the valve shank is connected to the armature, in particular formed integrally with the armature. When energized, the magnetic actuator adjusts the armature and the valve shank fastened thereto along the movement direction of the valve lamella, whereby at the same time the valve lamella is moved from the open position into the closed position and vice versa. Here, the arrangement may be such that the valve lamella is closed when energized, or may be such that the valve lamella is opened when energized. The movement activation arrangement is configured such that, in all operating positions of the valve arrangement, the armature and the pole piece are arranged so as to be spaced apart from one another, which has the advantage that, during switching of the valve arrangement, contact between the armature and pole piece no longer occurs, and thus the noise emissions of the valve arrangement is be considerably reduced.

Here, a spring element is provided which holds the armature and the pole piece so as to be spaced apart from one another. The spring element is particularly advantageously formed by the valve lamella. In a refinement, specifically in a refinement of the valve arrangement in which the latter is open when de-energized, the valve lamella, by its spring force, holds the armature in the rest position, so as to be spaced apart to a maximum extent from the pole piece.

A high-pressure pump for a fuel injection system of an internal combustion engine has a pressure chamber for applying high pressure to fuel, and has an inlet valve for the admission of the fuel into the pressure chamber, wherein the inlet valve is formed by a valve arrangement as described above. Here, the pressure chamber is formed on the first valve disk side.

BRIEF DESCRIPTION OF THE DRAWINGS

Refinements of the invention will be discussed in more detail below on the basis of the appended drawings, in which.

DETAILED DESCRIPTION

Figure 1:
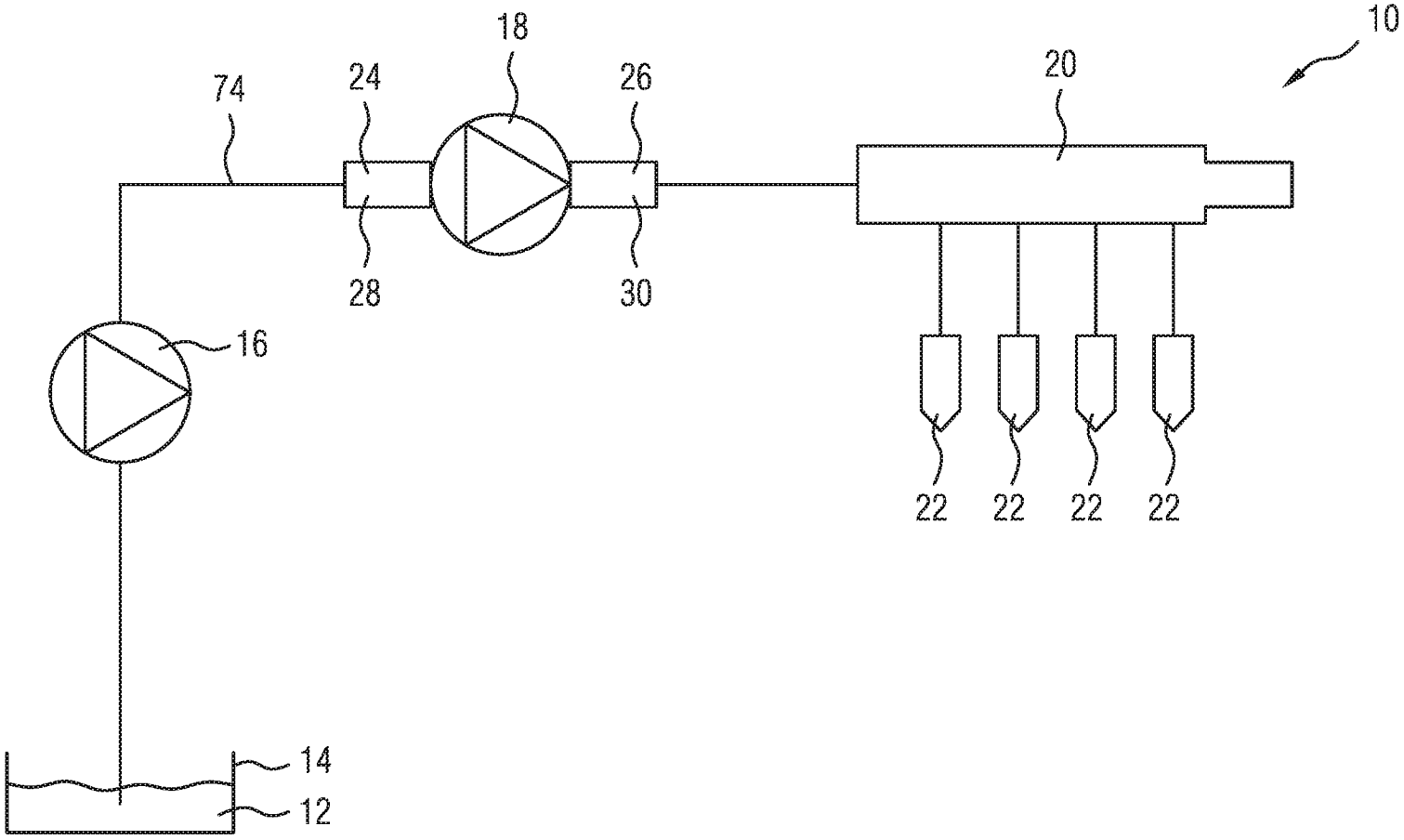
FIG. 1 is a schematic illustration of a fuel injection system of an internal combustion engine having a high-pressure pump and having valve arrangements arranged thereon.

FIG. 1 is a schematic illustration of a fuel injection system 10 of an internal combustion engine, which fuel injection system delivers a fuel 12 from a tank 14 via a predelivery pump 16, a high-pressure pump 18 and a fuel high-pressure accumulator 20 to injectors 22 which then inject the fuel 12 into combustion chambers of the internal combustion engine.

The fuel 12 is introduced into the high-pressure pump 18 via a valve arrangement 24, and is discharged from the high-pressure pump 18 under pressure via a further valve 26.

Figure 2:
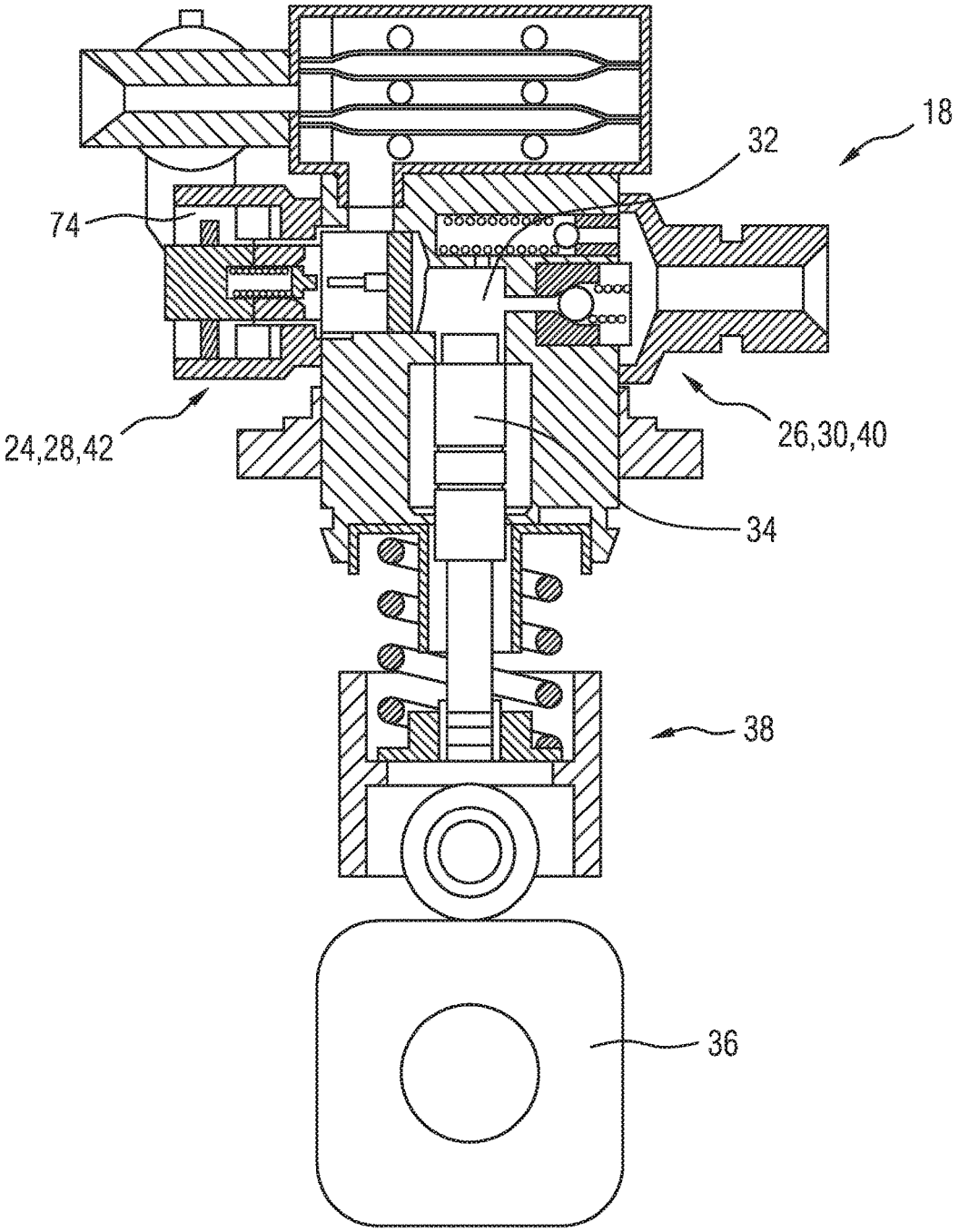
FIG. 2 shows a longitudinal section of the high-pressure pump and the valve arrangements arranged thereon from FIG. 1.

FIG. 2 shows a longitudinal section through the high-pressure pump 18 with the valve arrangement 24 as inlet valve 28 and with the valve 26 as outlet valve 30, which valve arrangement and valve are arranged at a pressure chamber 32 of the high-pressure pump 18. During the operation of the high-pressure pump 18, a piston 34, which performs a translational movement, periodically varies the volume of the pressure chamber 32. Here, the piston 34 is driven by a camshaft 36 which, in the present example embodiment, is in operative contact with the piston 34 via a tappet 38.

Figure 3:
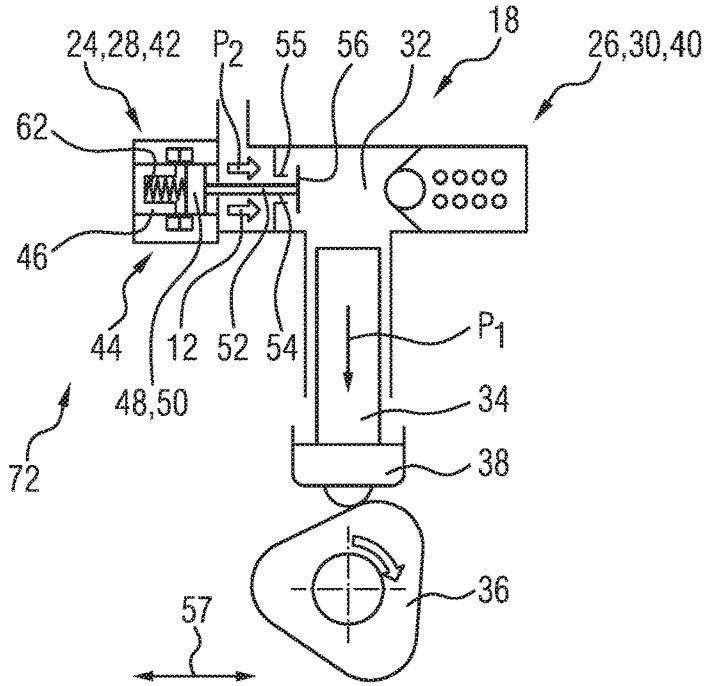
FIG. 3 is a first schematic illustration, in longitudinal sectional view, of the high-pressure pump from FIG. 2 with a valve arrangement fully open.
Figure 4:
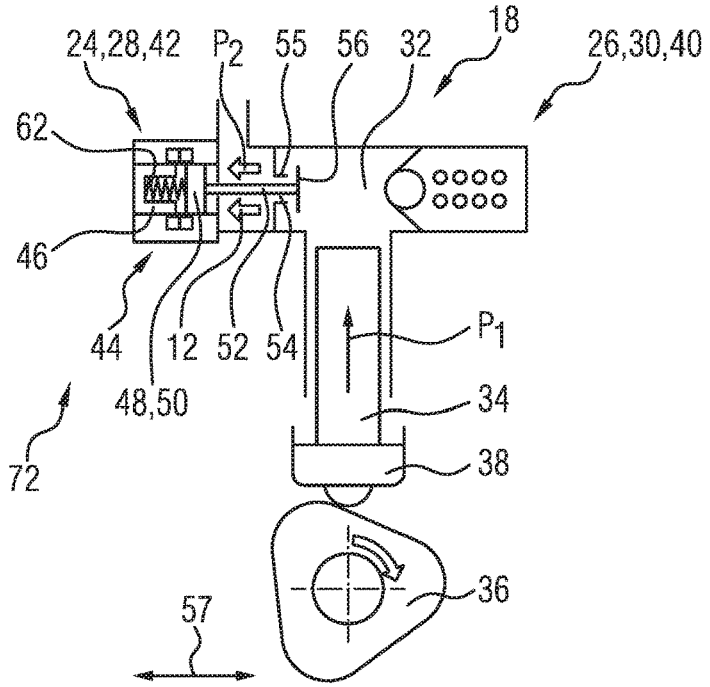
FIG. 4 is a second schematic illustration, in longitudinal sectional view, of the high-pressure pump from FIG. 2 with a valve arrangement fully open.
Figure 5:
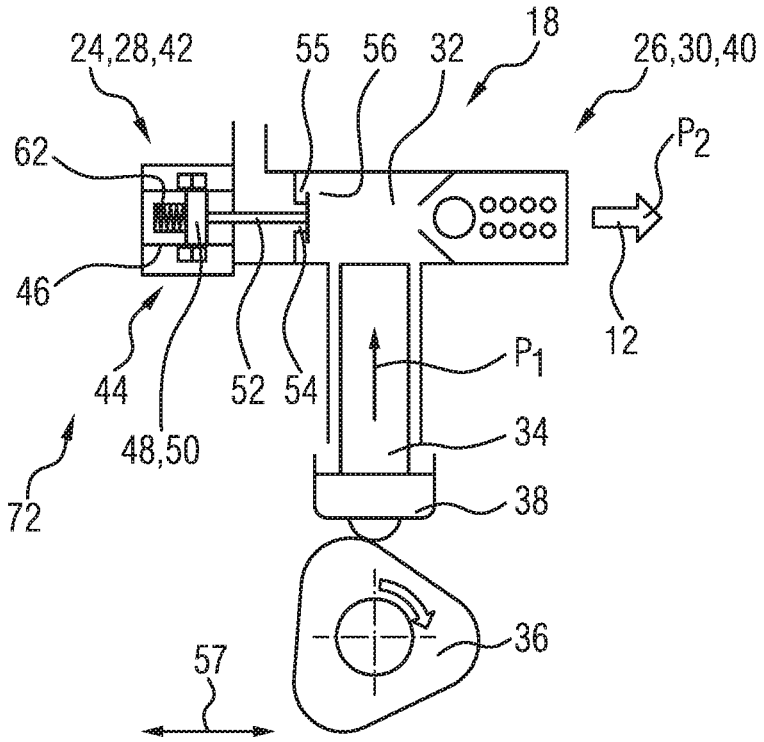
FIG. 5 is a third schematic illustration, in longitudinal sectional view, of the high-pressure pump from FIG. 2 with a valve arrangement fully closed.

FIG. 3 to FIG. 5 schematically show different operating states of the piston 34 and of the inlet valve 28 in longitudinal sectional view through the high-pressure pump 18 during the operation of the high-pressure pump 18.

Here, in the present embodiment, the outlet valve 30 is a simple check valve 40 which opens passively owing to a pressure prevailing in the pressure chamber 32 and which automatically closes again in the absence of the pressure.

In the present embodiment, the inlet valve 28 is an active magnetic valve 42 which has a magnetic actuator 44 with a static pole piece 46 and with a movable armature 48 as a positioning element 50. To the armature 48 there is fastened a valve shank 52 which engages through a valve opening 54 in a valve disk 55 and to which there is fastened a valve lamella 56 which, when moved in the direction of the pole piece 46, may be placed in contact with a valve disk surface 58 on a first valve disk side 60 of the valve disk 55, in order to thereby close the valve opening 54. In the present embodiment, the inlet valve 28 is an inlet valve 28 which is open when de-energized, that is to say, when the magnetic valve 42 is not energized, the pole piece 46 and the armature 48 are, owing to a spring 62, arranged with a maximum spacing 64 to one another, such that the valve lamella 56 is situated in an open position. At the same time, the piston 34 is on the path toward the bottom dead center of the piston, as indicated by the arrow $P_1$. Owing to the movement of the piston 34 and the open position of the valve lamella 56, fuel 12 flows, as indicated by the arrows $P_2$, into the pressure chamber 32 of the high-pressure pump 18. The outlet valve 30 is in its closed position.

FIG. 4 schematically illustrates, in longitudinal sectional view, how the piston 34 moves toward the top dead center thereof. The valve lamella 56 remains in the open position owing to the spring force of the compression spring 62, because the pressure built up in the pressure chamber 32 by the piston 34 is not yet sufficient to overcome the spring force of the compression spring 62 and close the valve lamella 56. The outlet valve 30, too, is still situated in the closed position thereof. Owing to the valve lamella 56 being in the open position, fuel 12 flows out of the pressure chamber 32 again through the inlet valve 28.

In FIG. 5, the piston 34 is situated a short distance before the top dead center thereof, and the pressure that has been built up in the pressure chamber 32 by the movement of the piston 34 is sufficient to close the valve lamella 56. At the same time, the pressure is also sufficient to open the outlet valve 30.

The spring force of the compression spring 62 prevents the high-pressure pump 18 from operating with full delivery action, that is to say all of the fuel 12 that has flowed into the pressure chamber 32 is, as a result of immediate closure of the valve lamella 56, charged with pressure, and thus all of the elements situated downstream of the pressure chamber 32 are subjected to load.

The valve lamella 56 is designed to be so thin that the lamella is deformable. Furthermore, for the closure of the valve opening 54, the valve lamella moves along a movement direction 57 which is oriented along a longitudinal axis of the valve shank 52.

Figure 6:
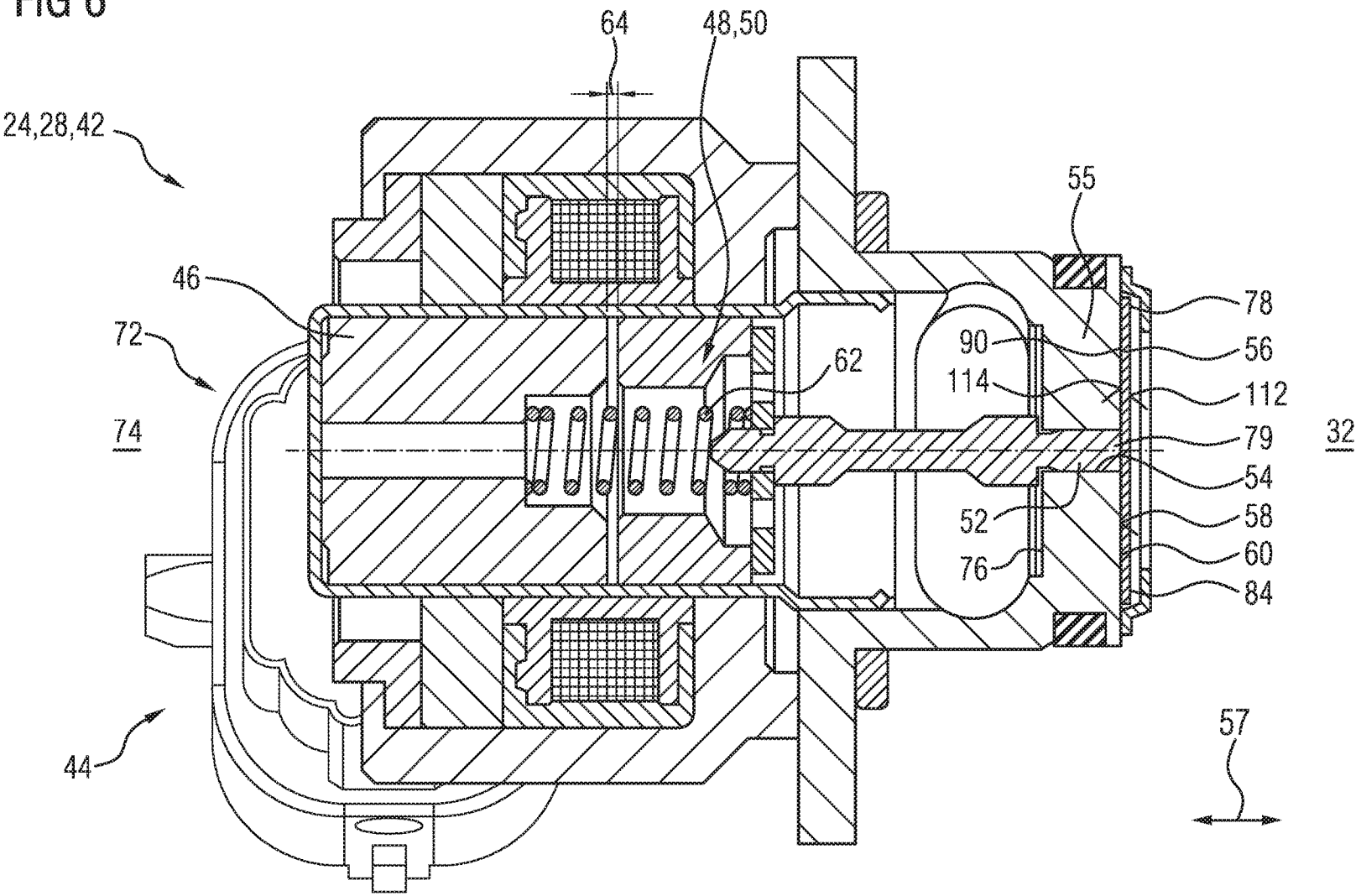
FIG. 6 is a first detailed longitudinal sectional illustration of the valve arrangement from FIGS. 3-5.
Figure 7:
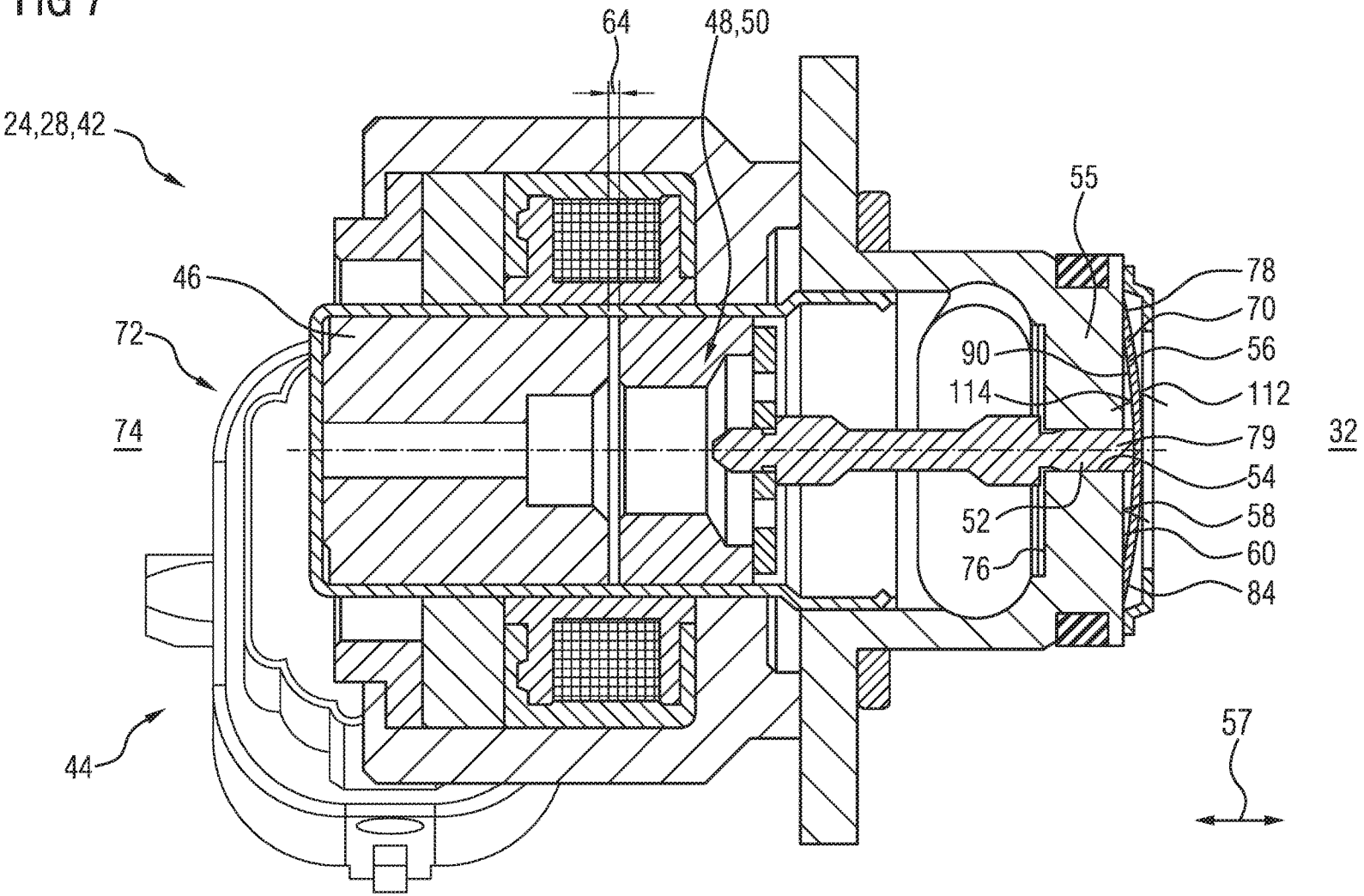
FIG. 7 is a second detailed longitudinal sectional illustration of the valve arrangement from FIGS. 3-5.

FIG. 6 and FIG. 7 show a longitudinal section through the valve arrangement 24, in the form of an inlet valve 28, in two different embodiments.

Here, FIG. 6 shows an arrangement which has the compression spring 62, whereas, in FIG. 7, the compression spring 62 has been omitted, because the valve lamella 56 itself forms a spring element 70.

The elements of the magnetic valve 42, specifically the pole piece 46 and the armature 48, and the valve shank 52 together form a movement activation arrangement 72 which may actively move the valve lamella 56. If the valve arrangement 24 is an open valve, the movement activation arrangement 72 moves the valve lamella 56 into the closed position when energized. However, if the valve arrangement 24 is designed to be closed when de-energized, the movement activation arrangement 72, when energized, moves the valve lamella 56 into the open position. For the separation of the pressure chamber 32 from a suction line 74, the valve disk 55 is provided, which valve disk separates the first valve disk side 60 on the side of the pressure chamber 32 from a second valve disk side 76 on the side of the suction line 74. The two valve disk sides 60, 76 are fluidly connected to or in fluid communication with one another by the valve opening 54. To shut off the fluidic connection, the valve lamella 56 is provided, which is deformable such that the lamella may bear closely against the valve disk surface on the first valve disk side 60 in order to thereby sealingly close off the valve opening 54.

By virtue of the fact that the valve shank 52 and the valve lamella 56 are firmly fastened to one another, it may be achieved that the pole piece 56 and the armature 48, which is connected to the valve shank 52, are spaced apart from one another in all operating positions of the valve arrangement 24. Specifically, if the valve shank 52 is so short that the armature 48 fastened thereto does not strike the pole piece 46 when the valve opening 54 is fully closed by the valve lamella 56, a permanent spacing 64 between the pole piece 46 and the armature 48 is realized. In this way, a loud impacting noise during the operation of the valve arrangement 24 may be prevented.

FIG. 6 and FIG. 7 show embodiments in which the valve arrangement is designed as a valve which is open when de-energized. Here, in FIG. 6, when the valve arrangement 24 is in the rest position, the compression spring 62 holds the armature 48 with a maximum spacing 64 to the pole piece 46, and thus holds the valve lamella 56 in the open position.

By contrast, no compression spring 62 is provided in FIG. 7, it rather being the case that the valve lamella 56 itself is in the form of a spring element 70, the spring force of which acts counter to a force acting on the valve lamella 56 from the pressure chamber 32, and the valve lamella thus holds itself open. In this way, the compression spring 62 between armature 48 and pole piece 46 is omitted.

If the valve lamella 56 was not connected to the valve shank 52, and the valve lamella 56 was not in the form of a spring element 70, this relieving of the downstream elements of load would function only until the valve shank 52 experiences a malfunction, for example a breakage. As a result of a breakage, the valve shank 52, because the valve shank is not connected to the valve lamella 56, would no longer be able to hold the valve lamella in the open position, and the valve lamella 56 would immediately close as soon as only a low pressure is built up in the pressure chamber 32. As a result, the high-pressure pump 18 would impart a full delivery action. This normally makes it necessary to provide a safety valve which relieves the downstream elements of load in the event of the high-pressure pump 18 imparting a full delivery action.

Provision is, however, now made for the valve shank 52 to be connected to the valve lamella 56, and for the valve lamella 56 to be formed as a spring element 70. Now, if the valve shank 52 breaks, the valve arrangement 24 remains permanently in the open state, such that it is not possible for an excessive pressure to act on the following elements downstream of the pressure chamber 32. This is because the high-pressure pump 18 no longer imparts a full delivery action, it rather being the case that the valve lamella 56 remains permanently in the open position, such that pressurized fuel 12 may flow back again to the suction line 74 and does not exert load on those elements of the fuel injection system 10 which are situated downstream of the high-pressure pump 18.

It is thus possible to dispense with an additional safety valve which relieves the system of load when the high-pressure pump 18 imparts a full delivery action.

An additional advantage is that, when the energization of the valve arrangement 24 has ended, the spring force of the spring element 70 has the effect that the valve shank 52 no longer strikes the valve disk 55 at such a high speed, because the impacting speed and thus the energy is lower. This also contributes to a reduction of the generation of noise by the valve arrangement 24.

To ensure the above-described functionality of the valve arrangement 24 even in the event of malfunctions of the valve shank 52, it is advantageous if, here, the spring force of the valve lamella 56 is configured so as to be greater than the maximum hydraulic force exerted on the valve lamella 56 by the pressurized fuel 12. As a result, when not moved by the movement activation arrangement 72, the valve lamella 56 remains permanently in the open position, such that it is not possible for the high-pressure pump 18 to impart a full delivery action. In this way, it is, for example, also possible to dispense with a further safety valve, because even in the event of a breakage of the valve shank 52, the valve lamella 56 remains in the open position.

The valve lamella 56 may, for stabilization, also be advantageously connected at least in sections at a circumferential edge 78 to the valve disk 55.

FIG. 8 to FIG. 18 schematically show different embodiments for fixing the valve shank 52 to the valve lamella 56. In all embodiments, the valve shank 52 is advantageously connected to the valve lamella 56 such that an end 79, facing toward the first valve disk side 60 of the valve shank 52, is arranged in a central region 81 of the valve lamella 56.

Figure 8:
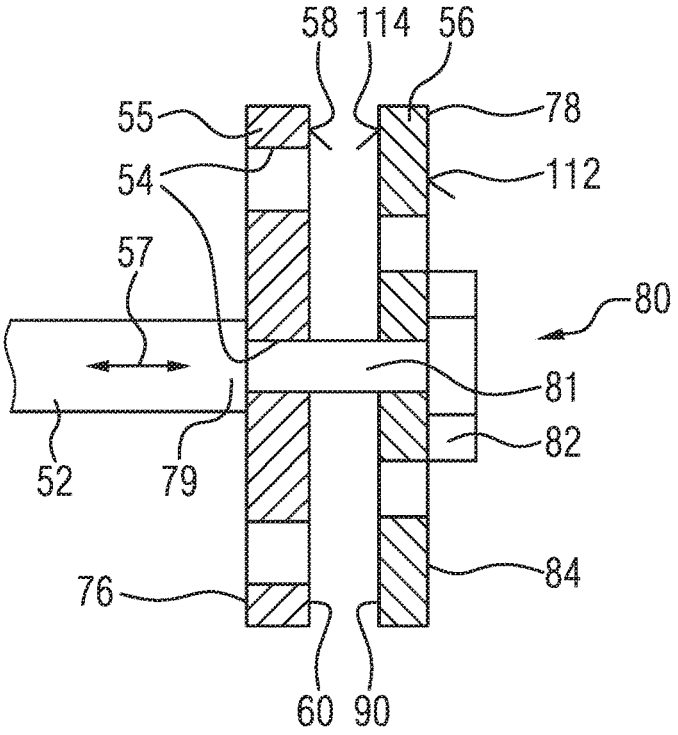
FIG. 8 is a schematic illustration of the connection of a valve lamella of the valve arrangement from FIG. 6 and FIG. 7 to a valve shank of the valve arrangement, according to a first example embodiment.

Here, FIG. 8 shows a screw connection 80, in which a screw element 82 engages through the valve lamella 56 proceeding from a first valve lamella side 84, facing away from the second valve disk side 76, and bears against the valve lamella 56. The screw element 82 is then screwed into the valve shank 52.

Figure 9:
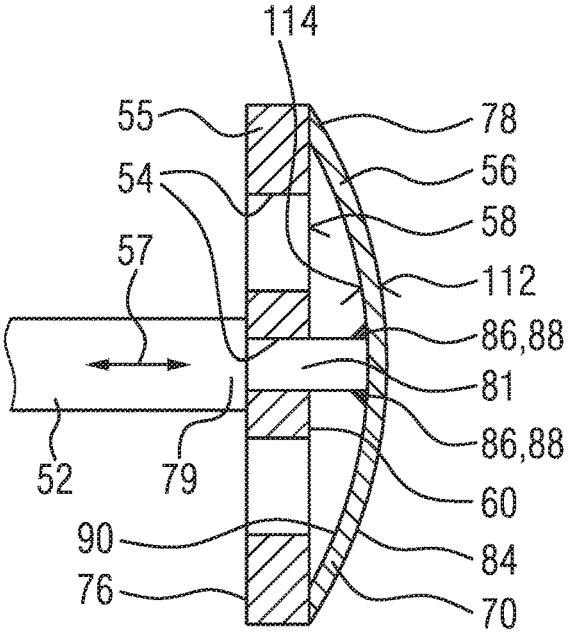
FIG. 9 is a schematic illustration of the connection of the valve lamella of the valve arrangement from FIG. 6 and FIG. 7 to the valve shank of the valve arrangement, according to a second example embodiment.

FIG. 9 shows an embodiment in which the valve shank 52 is connected to the valve lamella 56 by a welded connection 86. Here, a weld seam 88 of the welded connection 86 is arranged so as to be situated on a second valve lamella side 90 situated opposite the first valve lamella side 84, so as to exert a pressure on the valve lamella 56 such that the valve openings 54, which would be closed off by the valve lamella 56, remain open. By virtue of the fact that the end 79 of the valve shank 52 is arranged in the central region 81 of the valve lamella 56, and by virtue of the fact that the weld seam 88 exerts a pressure on the valve lamella 56, the valve lamella 56 is preloaded and acts as a spring element 70 counter to a force acting on the valve lamella 56 from the first valve lamella side 84.

FIG. 10 to FIG. 16 schematically show embodiments with sleeve-shaped receiving elements 92 which are used to connect the valve shank 52 to the valve lamella 56.

Figure 10:
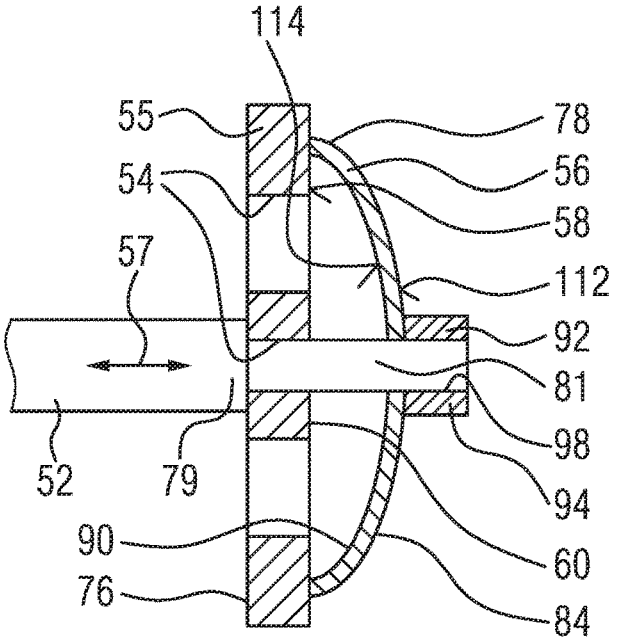
FIG. 10 is a schematic illustration of the connection of the valve lamella of the valve arrangement from FIG. 6 and FIG. 7 to the valve shank of the valve arrangement according to a third example embodiment.
Figure 11:
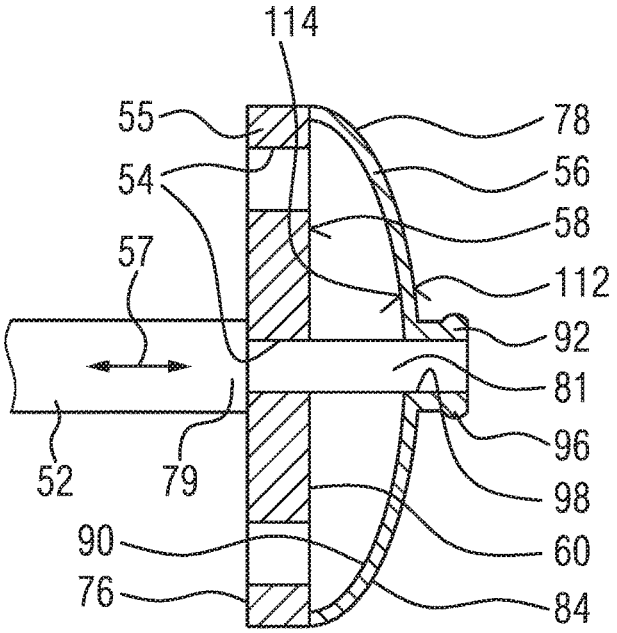
FIG. 11 is a schematic illustration of the connection of the valve lamella of the valve arrangement from FIG. 6 and FIG. 7 to the valve shank of the valve arrangement according to a fourth example embodiment.
Figure 12:
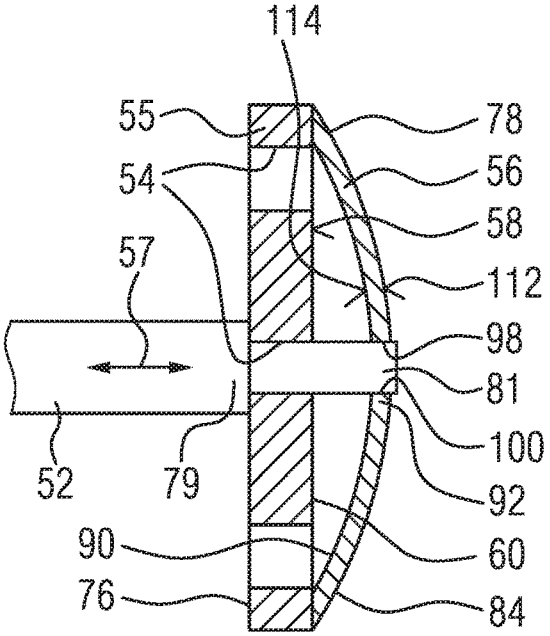
FIG. 12 is a schematic illustration of the connection of the valve lamella of the valve arrangement from FIG. 6 and FIG. 7 to the valve shank of the valve arrangement according to a fifth example embodiment.
Figure 13:
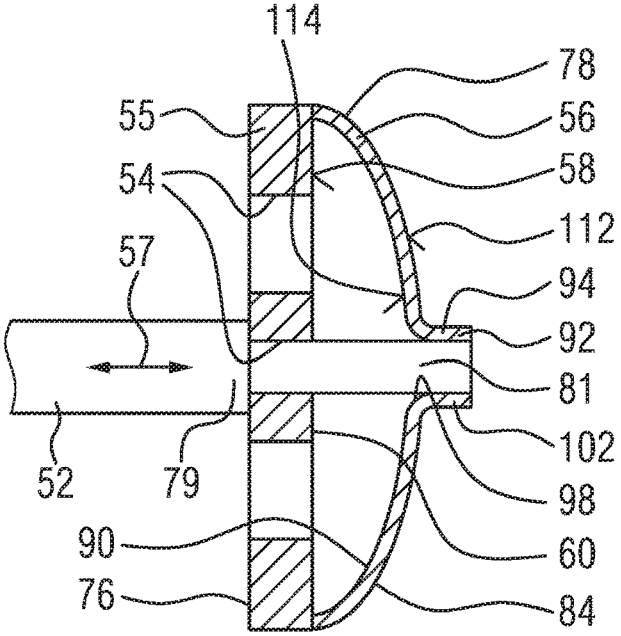
FIG. 13 is a schematic illustration of the connection of the valve lamella of the valve arrangement from FIG. 6 and FIG. 7 to the valve shank of the valve arrangement according to a sixth example embodiment.
Figure 14:
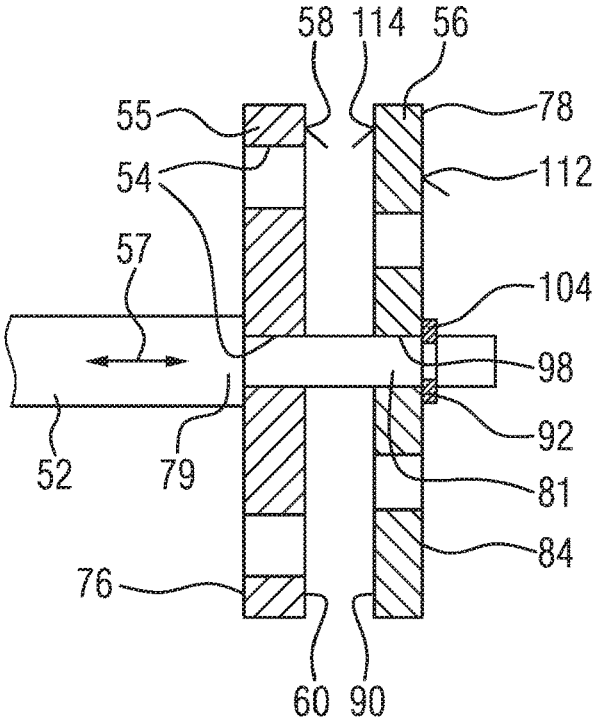
FIG. 14 is a schematic illustration of the connection of the valve lamella of the valve arrangement from FIG. 6 and FIG. 7 to the valve shank of the valve arrangement according to a seventh example embodiment.
Figure 15:
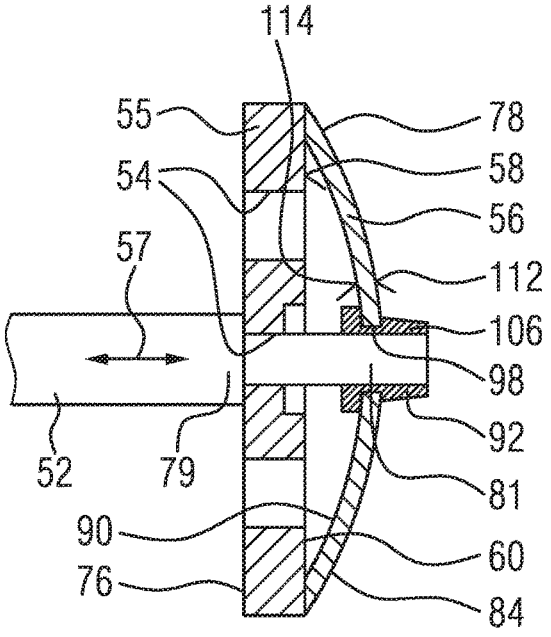
FIG. 15 is a schematic illustration of the connection of the valve lamella of the valve arrangement from FIG. 6 and FIG. 7 to the valve shank of the valve arrangement according to an eighth example embodiment.
Figure 16:
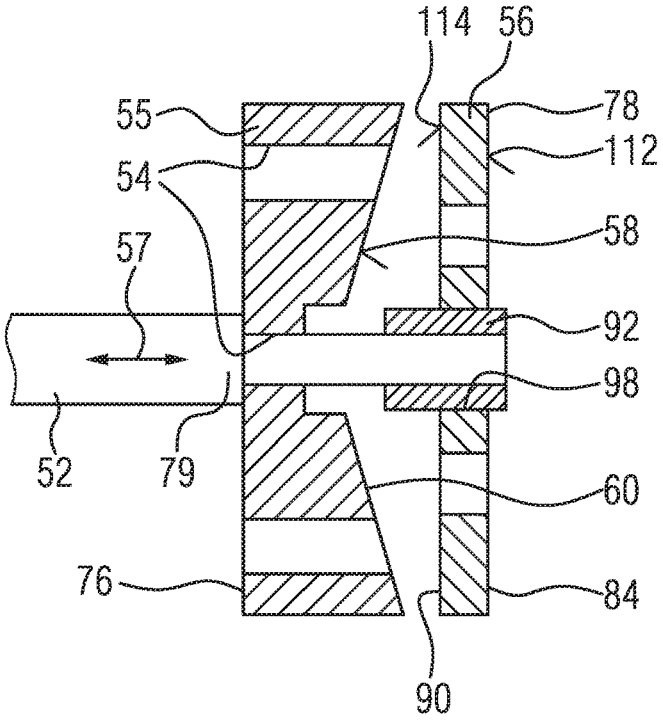
FIG. 16 is a schematic illustration of the connection of the valve lamella of the valve arrangement from FIG. 6 and FIG. 7 to the valve shank of the valve arrangement according to a ninth example embodiment.
Figure 17:
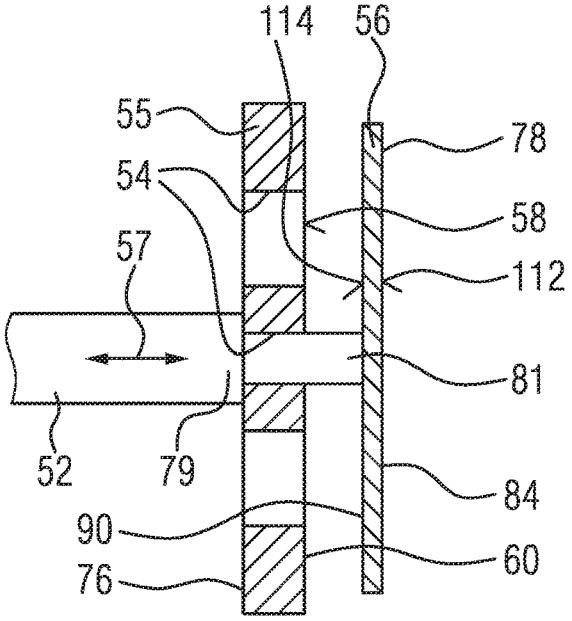
FIG. 17 is a schematic illustration of the connection of the valve lamella of the valve arrangement from FIG. 6 and FIG. 7 to the valve shank of the valve arrangement according to a tenth example embodiment.
Figure 18:
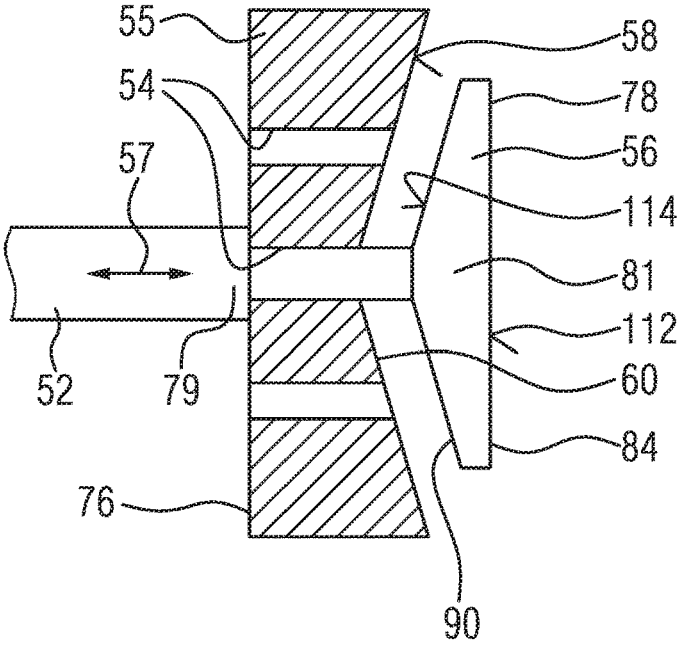
FIG. 18 is a schematic illustration of the connection of the valve lamella of the valve arrangement from FIG. 6 and FIG. 7 to the valve shank of the valve arrangement according to an eleventh example embodiment.
Figure 19:
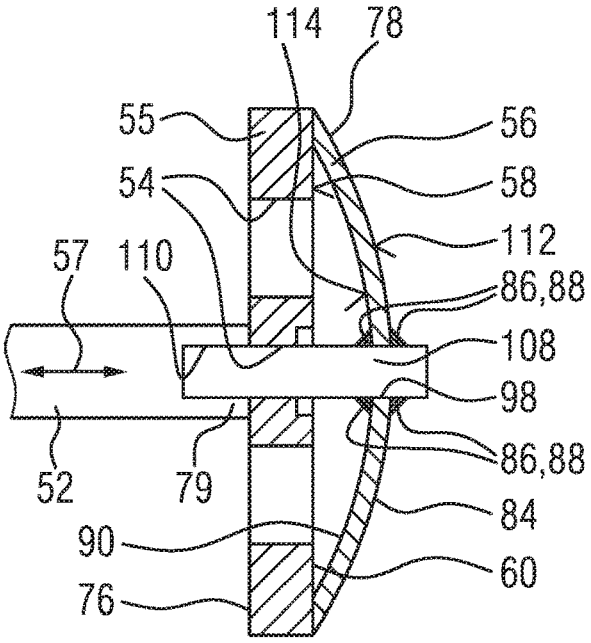
FIG. 19 is a schematic illustration of the connection of the valve lamella of the valve arrangement from FIG. 6 and FIG. 7 to the valve shank of the valve arrangement according to a twelfth example embodiment.

Here, in FIG. 10, the sleeve-shaped receiving element 92 is formed by a sleeve 94 which is fastened to the first valve lamella side 84. Here, FIG. 11 shows a bead 96 which is arranged as a sleeve-shaped receiving element 92 on the valve lamella 56 and at which the valve shank 52 is crimped, and thus connected by a form fit, to the receiving element 92. As shown in FIG. 12, a valve lamella opening 98 is provided in the valve lamella 56 in the central region 81, wherein the valve shank 52 is then in engagement with the opening walls 100 of the valve lamella opening 98. FIG. 13 shows an embodiment in which a punched-out or otherwise outwardly bent portion 102 is formed as the sleeve-shaped receiving element 92 on the valve lamella 56. In FIG. 14, as the sleeve-shaped receiving element 92, a circlip 104 is in engagement with the valve shank 52. FIG. 15 shows an arrangement in which an additional clip element 106 is the sleeve-shaped receiving element 92, which clip element is clipped into a valve lamella opening 98 of the valve lamella 56 in the central region 81, and into which clip element the valve shank 52 is inserted. FIG. 16 also shows a sleeve-shaped receiving element 92 which is welded to the valve lamella 56, wherein here, however, the valve disk 55 is of angled form, such that a spring force of the deformable valve lamella 56 is automatically realized without the valve lamella 56 having to be preloaded. FIG. 17 and FIG. 18 show valve lamellae 56 which are formed integrally with the valve shank 52. In FIG. 19, the valve lamella 56 has an engagement shank 108 which is welded to the valve lamella 56 and which engages through the valve opening 54 into a recess 110 of the valve shank 52. It is advantageous for the engagement shank 108 to also engage through the valve lamella 56 and to be fastened to the valve lamella 56 both at a first valve lamella surface 112 and at a second valve lamella surface 114.

By way of the valve arrangement 24 described above, the component costs in some embodiments may be lowered because the compression spring 62 is omitted and, for example, it is also possible for a holder for the valve lamella 56 to be omitted. It is thus the case, in general, that the risk of failure of the high-pressure pump 18 is lowered. Furthermore, it is also possible for the machining costs to be lowered because, for example, owing to the permanent spacing 64 of the pole piece 46 and armature 48, the two elements no longer require a chromium coating and ground portions. The generation of noise by the valve arrangement 24 during operation may also be considerably reduced overall. Since it is possible to realize lower power consumption during operation, it is also possible for the switching time to be optimized, and also to realize an optimization of the calibration on the vehicle. Altogether, the robustness of the valve arrangement 24 and thus also of the high-pressure pump 18 are increased. It is also possible for hydraulic pulsations in the low-pressure region to be reduced, and a safety valve that is normally provided may be omitted. It is also achieved that the power consumption is reduced, because the valve arrangement 24 no longer has to be switched to the full extent because, through the use of the valve lamella 56 in the embodiment as a spring element 70, the stroke is greatly reduced. In this way, it may be achieved that the vehicle calibration no longer has to be calibrated to that point in the current profile at which the armature 48 strikes the pole piece 46, but rather merely has to be calibrated to the point at which the valve lamella 56 is situated fully in the closed position thereof. Since the chromium layer on the pole piece 46 and armature 48 may be omitted, it is also the case that wear no longer occurs here. Furthermore, failures at the compression spring 62, or at a holding element that has acted as a stopper for the previously loose valve lamella 56, may no longer occur. The safety valve may be omitted entirely, or no longer has to be designed for robustness, because the safety valve only has to be designed for special cases such as, for example, the "hot soak" of the high-pressure pump 18. The pulsations in the low-pressure region are significantly reduced because the pole piece 46 and the armature 48 now no longer strike one another during switching, and thus the medium situated in between no longer has to be displaced to zero.

During the manufacturing process, it is possible for the valve shank 52 to be installed into a complete valve arrangement element in advance, wherein then, the valve lamella 56 together with the installed valve shank 52 is pushed through the valve disk 55. The arrangement may then be inserted as an entire element into the pump housing of the high-pressure pump 18.

It is furthermore also possible for the valve disk 55 to be fixedly incorporated as a constituent part of the housing, which is more robust with respect to high combustion chamber pressures. Here, it is then the case that the valve lamella 56 with the valve shank 52 installed thereon is inserted from the high-pressure side, that is to say from the direction of the pressure chamber 32, and the other elements of the valve arrangement 24 are inserted from the other side, specifically from the direction of the suction line 74.

As a third possibility, it is also possible for the valve disk 55 to be inserted, with a preassembled assembly composed of valve shank 52 and valve lamella 56, into the structural space, for a supporting ring to then be pushed in, and for such supporting ring to be fixed by a weld seam.

It is particularly advantageous if, in the de-energized state, the valve lamella 56 is no longer planar but has a concave internal stress, that is to say a spring force. The internal stress is advantageously of such a magnitude that the backflowing medium in the pressure phase cannot push the valve lamella 56 back. The preload makes it possible, in a partial delivery situation, for a flow cross section for backflowing medium to be kept free.

Embodiments have been described herein in an illustrative manner, and it is to be understood that the terminology which has been used is intended to be in the nature of words of description rather than of limitation. Obviously, many modifications and variations of the invention are possible in light of the above teachings. The description above is merely exemplary in nature and, thus, variations may be made thereto without departing from the spirit and scope of the invention as defined in the appended claims.

We claim:

1. A valve arrangement for a fuel injection system of an internal combustion engine, comprising:

a valve disk including at least one valve opening arranged in the valve disk, wherein the valve opening fluidly connects to one another a first valve disk side and a second valve disk side situated opposite the first valve disk side, which first and second valve disk sides are separated from one another by the valve disk, a deformable valve sheet which is movable along a movement direction and which serves for opening and closing the valve opening, which valve sheet, in order to close the valve opening, is selectively brought into contact with a valve disk surface on the first valve disk side, and a movement activation arrangement for activating a movement of the valve sheet along the movement direction, the movement activation arrangement having a valve shank which is fixed to the valve sheet, wherein the valve shank is fixed to the valve sheet by a welded connection, wherein a weld seam of the welded connection is arranged on a second valve sheet side facing toward the second valve disk side, and the weld seam exerts a pressure on the valve sheet such that the valve opening remains open.

2. A valve arrangement for a fuel injection system of an internal combustion engine, comprising:

a valve disk including at least one valve opening arranged in the valve disk, wherein the valve opening fluidly connects to one another a first valve disk side and a second valve disk side situated opposite the first valve disk side, which first and second valve disk sides are separated from one another by the valve disk, a deformable valve sheet which is movable along a movement direction and which serves for opening and closing the valve opening, which valve sheet, in order to close the valve opening, is selectively brought into contact with a valve disk surface on the first valve disk side, a movement activation arrangement for activating a movement of the valve sheet along the movement direction, the movement activation arrangement having a valve shank which is fixed to the valve sheet, and a screw element, wherein the valve shank is fixed to the valve sheet by the screw element, wherein the screw element which bears against the valve sheet on a first valve sheet side facing away from the second valve disk side, and extends through the valve sheet.

3. A valve arrangement for a fuel injection system of an internal combustion engine, comprising:

a valve disk including at least one valve opening arranged in the valve disk, wherein the valve opening fluidly connects to one another a first valve disk side and a second valve disk side situated opposite the first valve disk side, which first and second valve disk sides are separated from one another by the valve disk, a deformable valve sheet which is movable along a movement direction and which serves for opening and closing the valve opening, which valve sheet, in order to close the valve opening, is selectively brought into contact with a valve disk surface on the first valve disk side, a movement activation arrangement for activating a movement of the valve sheet along the movement direction, the movement activation arrangement having a valve shank which is fixed to the valve sheet, and a sleeve-shaped receiving element, the sleeve-shaped receiving element is arranged on the valve sheet and is in engagement with the valve shank, wherein the sleeve-shaped receiving element is crimped to the valve shank, formed as a circlip, formed as a clip element which engages behind a first valve sheet side facing away from the second valve disk side, or formed as opening walls of a valve sheet opening in the valve sheet.

4. A valve arrangement for a fuel injection system of an internal combustion engine, comprising:

a valve disk including at least one valve opening arranged in the valve disk, wherein the valve opening fluidly connects to one another a first valve disk side and a second valve disk side situated opposite the first valve disk side, which first and second valve disk sides are separated from one another by the valve disk, a deformable valve sheet which is movable along a movement direction and which serves for opening and closing the valve opening, which valve sheet, in order to close the valve opening, is selectively brought into contact with a valve disk surface on the first valve disk side, and a movement activation arrangement for activating a movement of the valve sheet along the movement direction, the movement activation arrangement having a valve shank which is fixed to the valve sheet, wherein the valve sheet is formed integrally with an end of the valve shank facing toward the first valve disk side of the valve disk, or wherein the valve sheet has an engagement shank which engages through the valve opening into a recess of the valve shank, such that the engagement shank engages through the valve sheet and is fastened to the valve sheet by welded connections to a first valve sheet surface on a first valve sheet side and to a second valve sheet surface on the second valve sheet side.

5. The valve arrangement as claimed in claim 1, wherein the valve sheet forms a spring element whose spring force is directed counter to a force which acts on the valve sheet from a first valve sheet side.

6. The valve arrangement as claimed in claim 5, wherein the spring force is greater than a predetermined force which corresponds to a maximum hydraulic force on the first valve sheet side during operation of the valve arrangement.

7. The valve arrangement as claimed in claim 1, wherein the valve sheet is fixed at least in sections to the valve disk.

8. The valve arrangement as claimed in claim 1, wherein the movement activation arrangement further comprises a magnetic actuator with a static pole piece and an armature which is connected to the valve shank and serves as a positioning element, wherein the armature and the pole piece are, in all operating positions of the valve arrangement, arranged so as to be spaced apart from one another, and wherein a spring element is formed by the valve sheet, the spring element preloads the armature into a rest position with a maximum spacing to the pole piece.

9. A valve arrangement for a fuel injection system of an internal combustion engine, comprising:

a valve disk including at least one valve opening arranged in the valve disk, wherein the valve opening fluidly connects to one another a first valve disk side and a second valve disk side situated opposite the first valve disk side, which first and second valve disk sides are separated from one another by the valve disk, a deformable valve sheet which is movable along a movement direction and which serves for opening and closing the valve opening, which valve sheet, in order to close the valve opening, is selectively brought into contact with a valve disk surface on the first valve disk side, and a movement activation arrangement for activating a movement of the valve sheet along the movement direction, the movement activation arrangement having a valve shank which is fixed to the valve sheet, wherein the valve sheet has an engagement shank which engages through the valve opening into a recess of the valve shank, such that the engagement shank engages through the valve sheet and is fastened to the valve sheet by welded connections to a first valve sheet surface on a first valve sheet side and to a second valve sheet surface on a second valve sheet side.

10. The valve arrangement of claim 1, wherein the valve sheet is shaped and forms a spring element so that the valve disk remains open when not closed by the movement activation arrangement.

11. A valve arrangement for a fuel injection system of an internal combustion engine, comprising:

a valve disk including at least one valve opening arranged in the valve disk, wherein the valve opening fluidly connects to one another a first valve disk side and a second valve disk side situated opposite the first valve disk side, which first and second valve disk sides are separated from one another by the valve disk, a deformable valve sheet which is movable along a movement direction and which serves for opening and closing the valve opening, which valve sheet, in order to close the valve opening, is selectively brought into contact with a valve disk surface on the first valve disk side, and a movement activation arrangement for activating a movement of the valve sheet along the movement direction, the movement activation arrangement having a valve shank which is fixed to the valve sheet, wherein the valve sheet has a dome shape having a central portion and a radial outer portion, the central portion of the sheet is at a greater distance from the valve disk and from the at least one valve opening than the a distance from the radial outer portion to the valve disk and to the at least one valve, when the valve sheet is not acted on by hydraulic forces or the movement activation arrangement.

* * * * *